US008217588B2

(12) United States Patent
McKinney

(10) Patent No.: US 8,217,588 B2
(45) Date of Patent: Jul. 10, 2012

(54) ADAPTIVE DIMMABLE LED LAMP

(75) Inventor: Steven McKinney, Piney Flats, TN (US)

(73) Assignee: Boca Flasher, Inc, Boca Raton, FL (US)

( * ) Notice: Subject to any disclaimer, the term of this patent is extended or adjusted under 35 U.S.C. 154(b) by 301 days.

(21) Appl. No.: 12/585,596

(22) Filed: Sep. 18, 2009

(65) Prior Publication Data

US 2011/0068704 A1 Mar. 24, 2011

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 37/00*** | (2006.01) |
| ***H05B 41/00*** | (2006.01) |
| ***H05B 39/00*** | (2006.01) |
| ***H05B 41/14*** | (2006.01) |
| ***H05B 43/00*** | (2006.01) |

(52) U.S. Cl. ..... 315/291; 315/119; 315/227 R

(58) Field of Classification Search ..... 315/220, 315/291, 51, 56, 201, 246, 247, 250; 362/555, 362/227

See application file for complete search history.

(56) References Cited

U.S. PATENT DOCUMENTS 7,088,059 B2 8/2006 McKinney et al.
7,358,679 B2 * 4/2008 Lys et al. ..... 315/51
2006/0017402 A1 * 1/2006 McKinney et al. ..... 315/291
2007/0222399 A1 * 9/2007 Bondy et al. ..... 315/291
2010/0134038 A1 * 6/2010 Shackle et al. ..... 315/291

OTHER PUBLICATIONS

"Introduction to Power Supplies" National Semiconductor, Sep. 2002, National Semiconductor Corp.
Super Nade, "Understanding Buck Regulators" www.overclockers.com, Nov. 25, 2006.

* cited by examiner

*Primary Examiner* — Jacob Y Choi
*Assistant Examiner* — Henry Luong
(74) *Attorney, Agent, or Firm* — John J. Yim

(57) ABSTRACT

A low voltage LED Lamp produces variable illumination in response to industry standard lighting dimmers, through the use of an input voltage monitoring circuit which variably controls the current output of an integral driver in response to sensed changes in the input voltage. Input circuitry is employed to provide "ghost" loading in the case of high frequency voltage sources such as that provided by certain electronic ballasts requiring minimum loads to operate. Additionally, the capacitive nature of prior art LED driving circuits is altered, increasing power factor and further helping electronic ballasts run properly. A firmware algorithm adapts to the output voltage capability of the driving transformer, dynamically adjusting the illumination to achieve the best dimming curve suited to each transformer. The circuit employed drives high power LEDs, and the lamp is preferably adapted to fit common MR16 size fixtures. Illumination output equivalent to similar size halogen bulbs is achieved.

14 Claims, 15 Drawing Sheets

Modified Dimming Buck-Boost LED Driver with Electronic Transformer Load Circuitry

Fig. 1 Typical LED Luminous Intensity vs. Forward Current
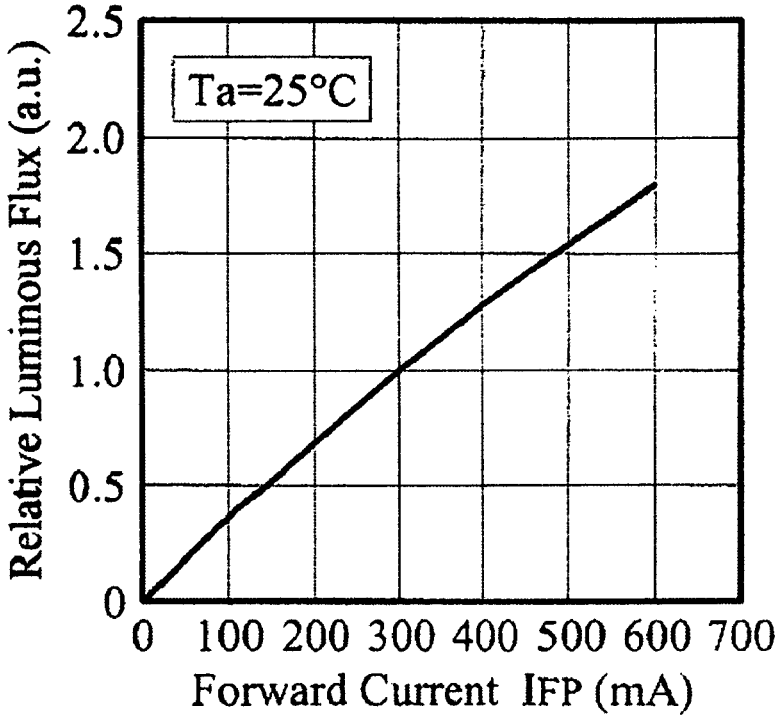

Fig. 2 Linear Regulator Driving LED Load
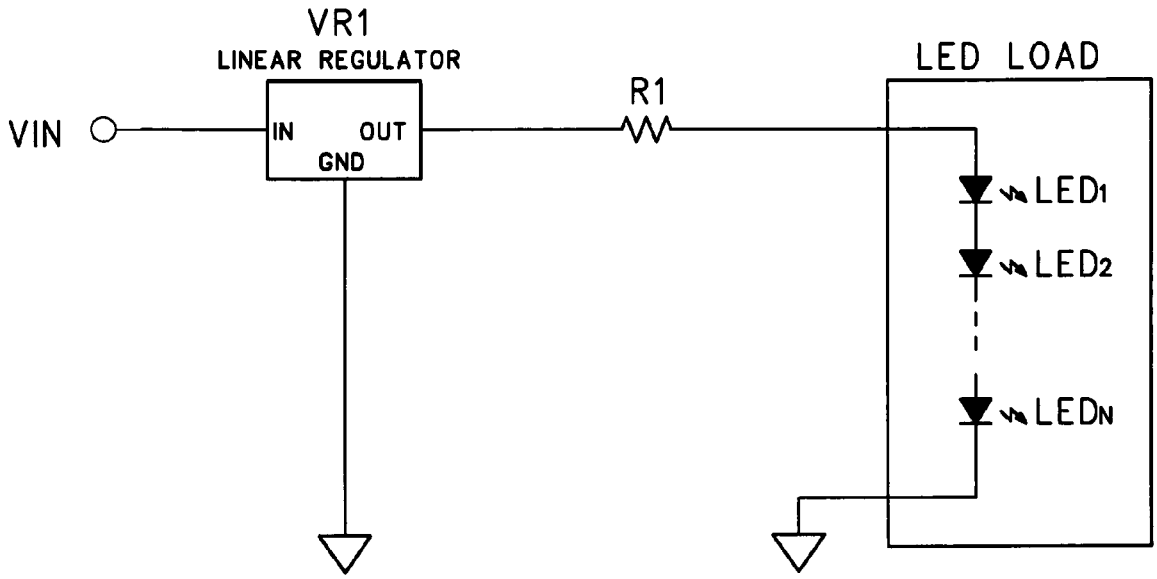

Fig. 3 Luminous Intensity vs. Input Voltage In A Linear Regulated LED Driving Circuit
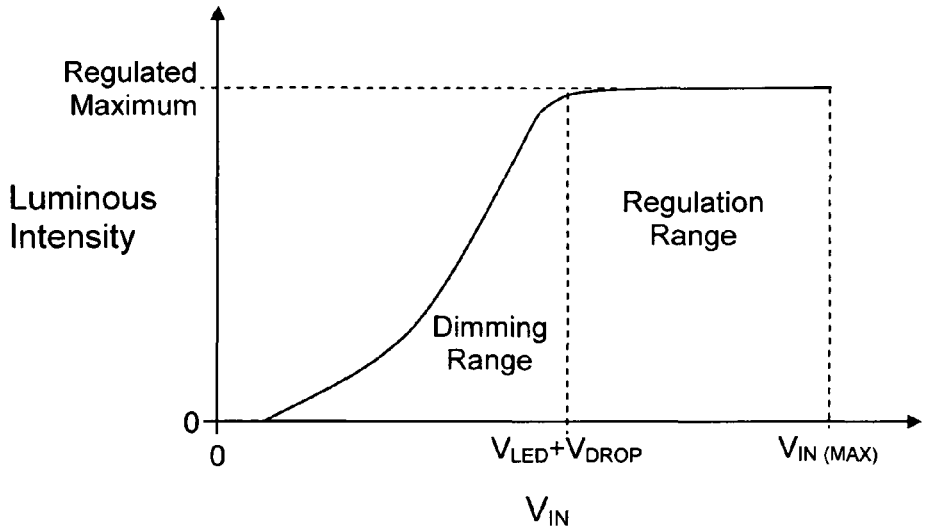

Fig. 4 Non-Linear Dimming Response In A Linear Regulated LED Driving Circuit
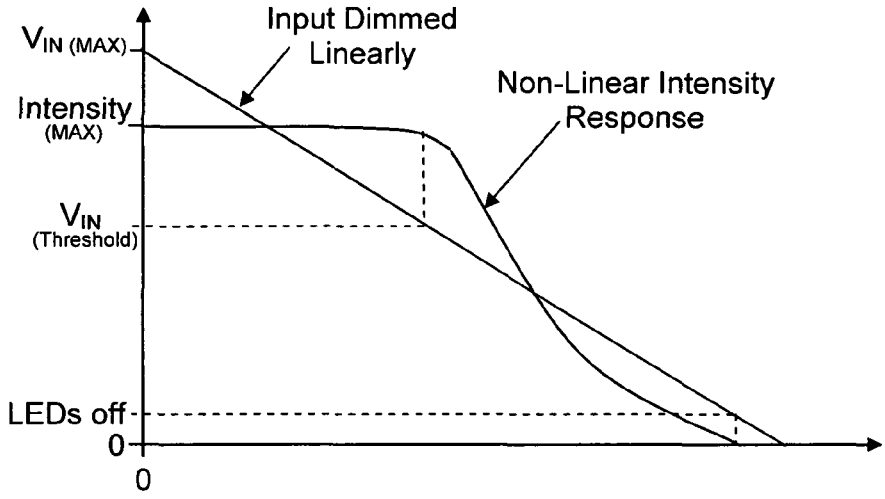

Fig. 5 Output Voltage Waveform of a Typical Low-Voltage Electronic Transformer
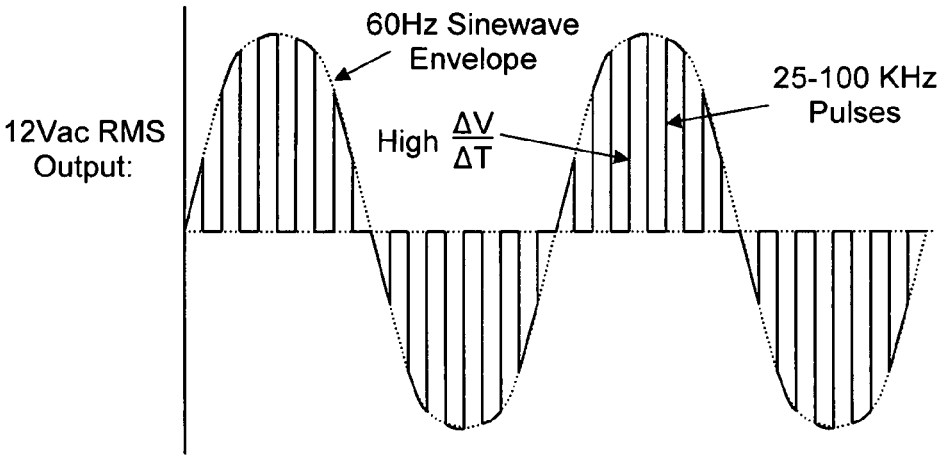

Fig. 6 Constant Current Buck Switching Regulator Led Driver Circuit
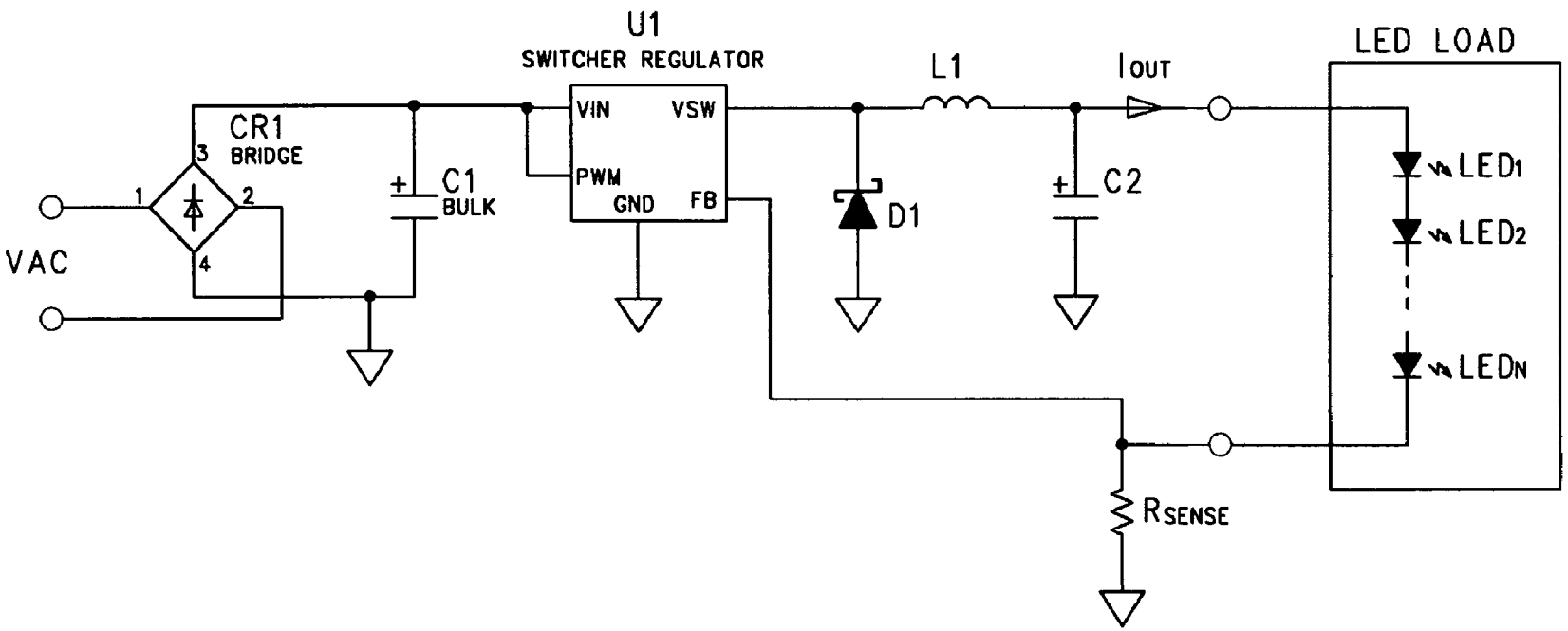

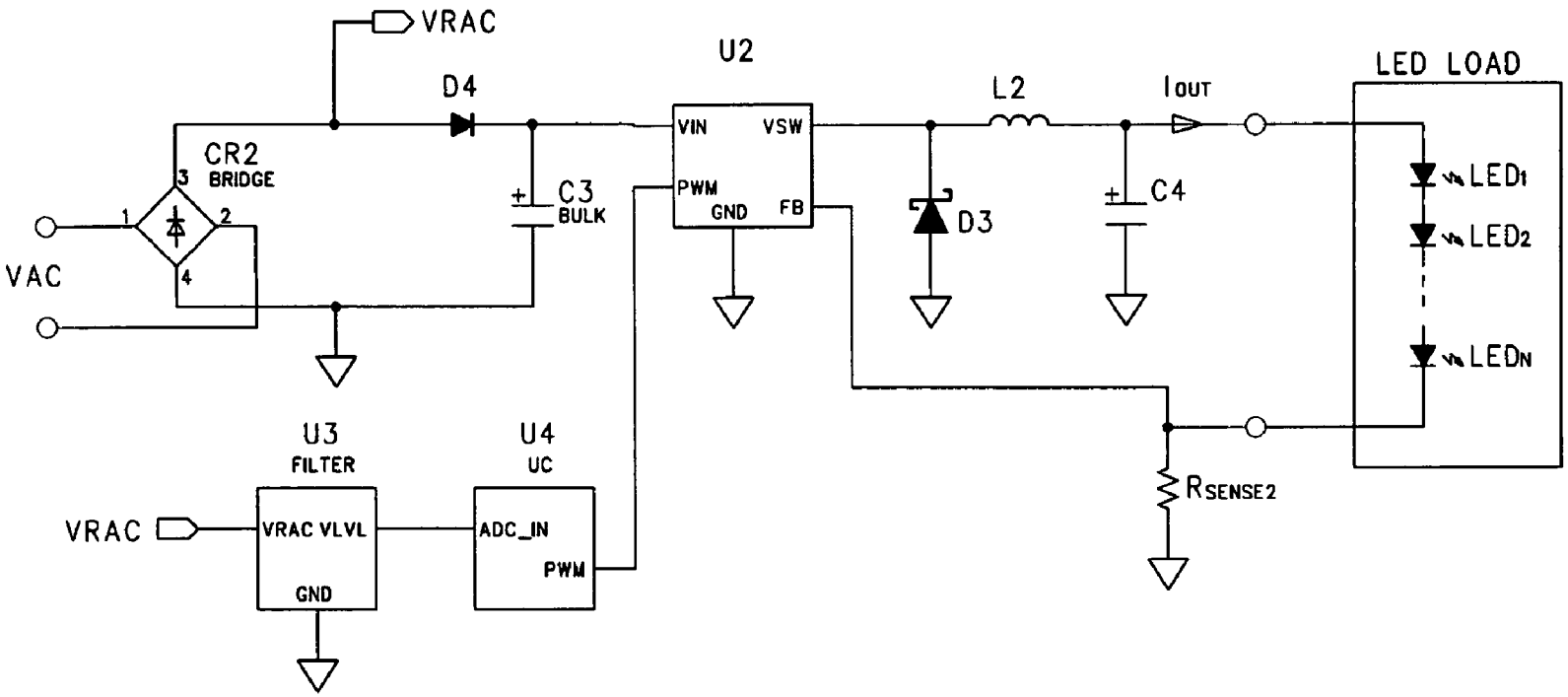
Fig. 7 Modified Dimming LED Driver Implemented In A Buck Regulator Circuit.

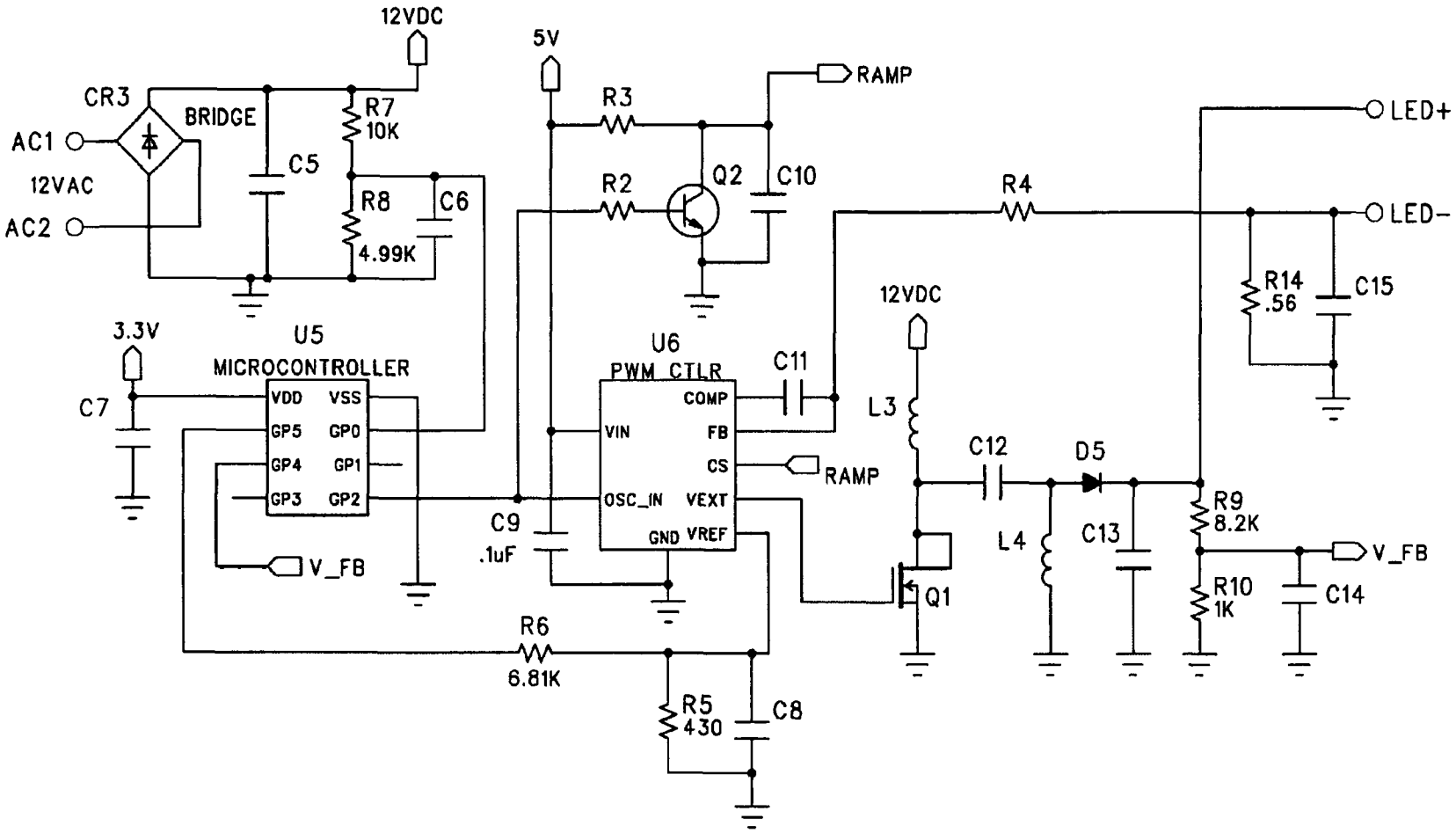
Fig. 8 Modified Dimming LED Driver Implemented in a Buck-Boost Regulator Circuit

Fig. 9 Power Circuit for Modified Dimming LED Driver
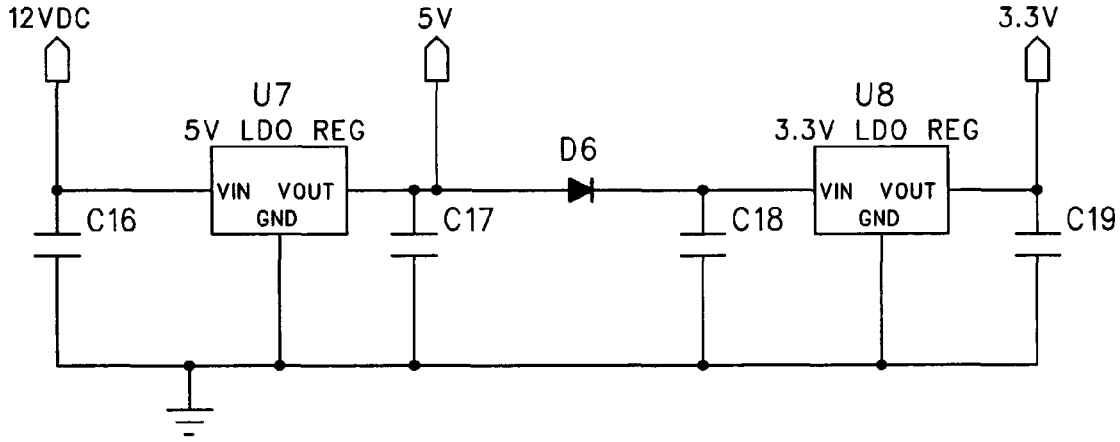

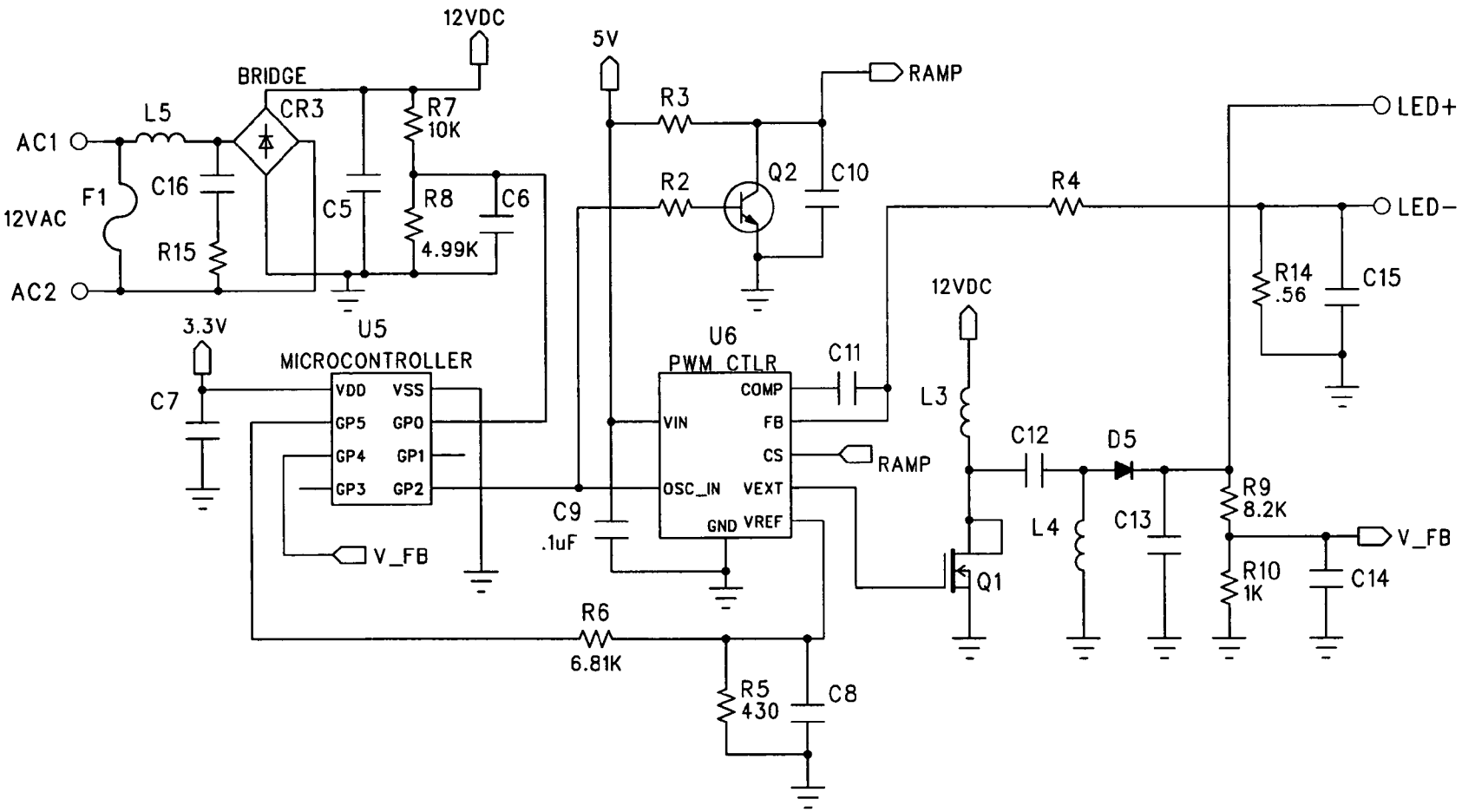
Fig. 10 Modified Dimming Buck-Boost LED Driver with Electronic Transformer Load Circuitry

Fig. 11 Ideal LED Lamp Output Intensity Dimming Curve
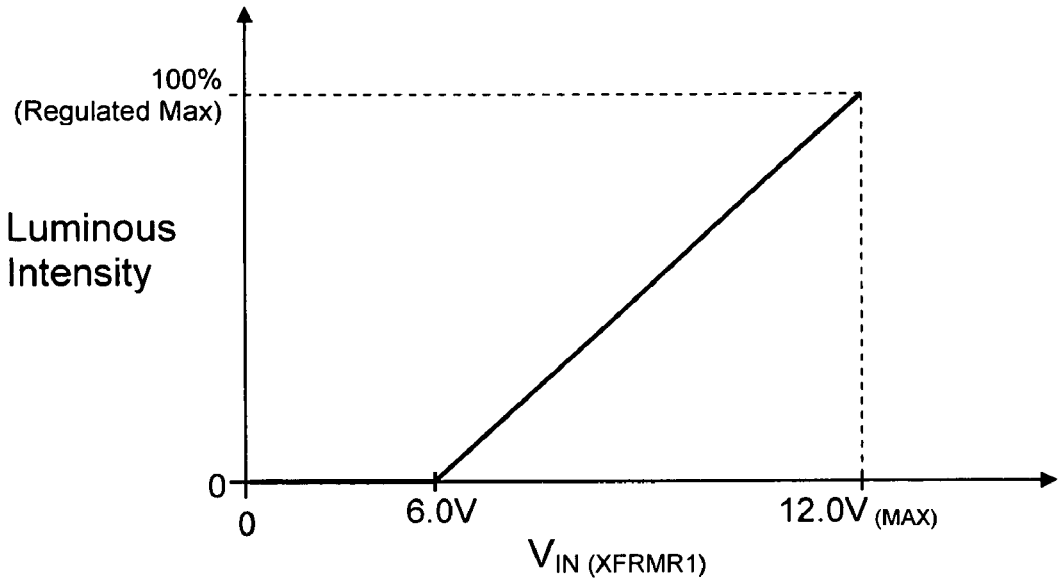

Fig. 12 Adapted vs. Non-Adapted LED Lamp Output Intensity Dimming Curve With Transformer Producing 13.0V Output
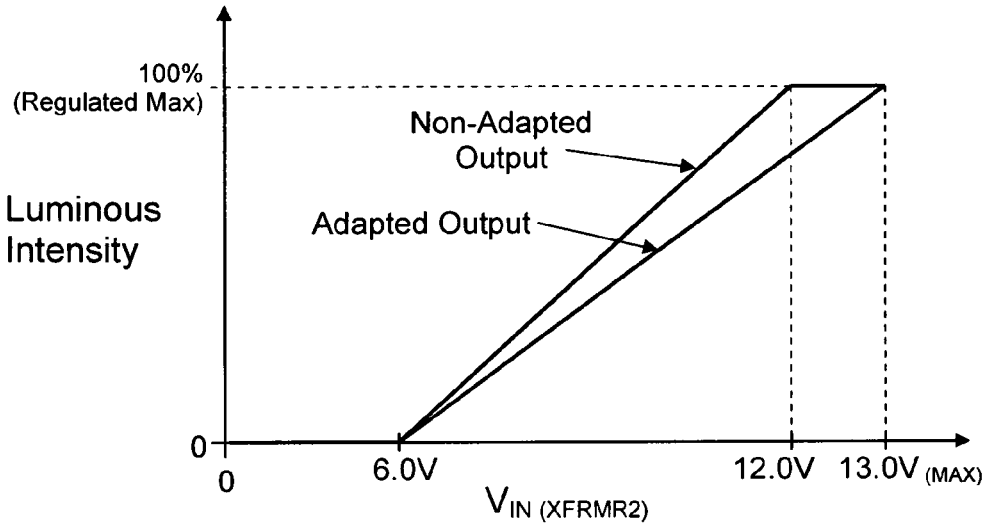

Fig. 13 Adapted vs. Non-Adapted LED Lamp Output Intensity Dimming Curve with Transformer Producing 11.0V Output
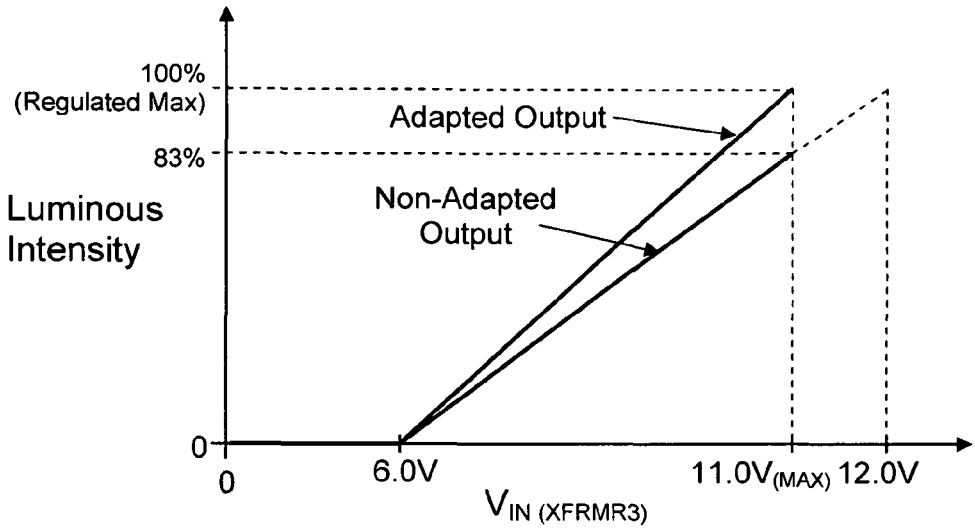

Fig. 14 Transformer Adapting Flowchart
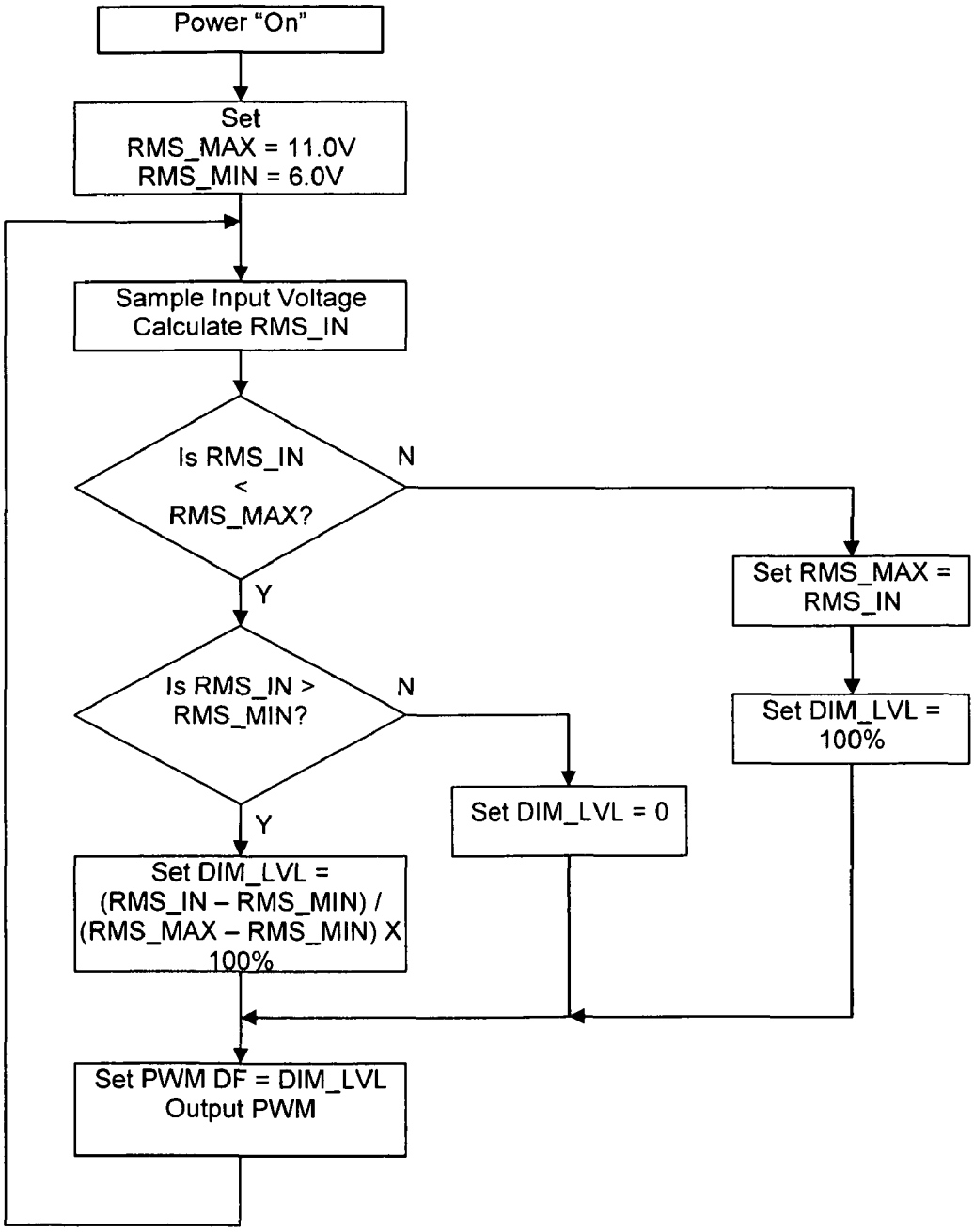

Fig. 15 Adaptive Dimmable MR16 LED Lamp
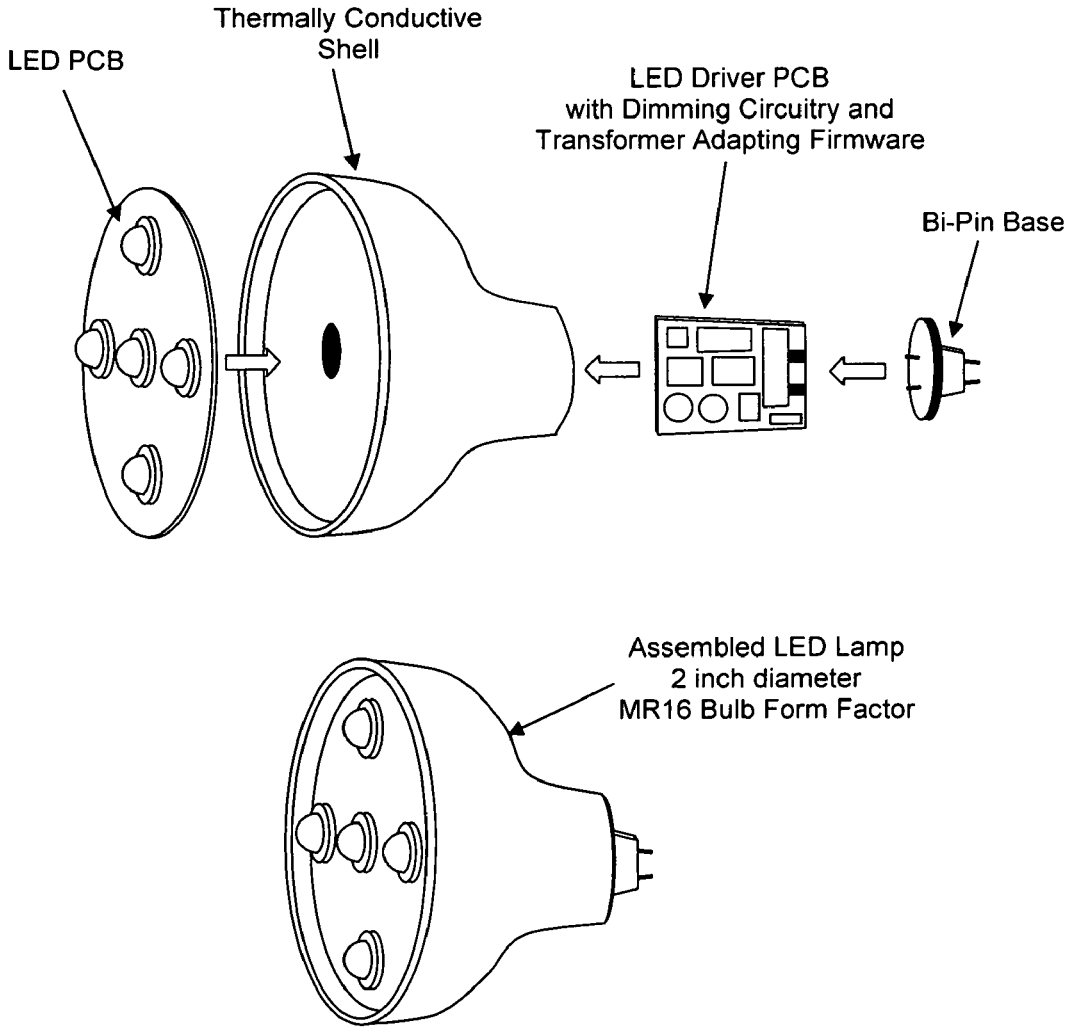

ADAPTIVE DIMMABLE LED LAMP

FIELD OF THE INVENTION

This invention relates to illumination devices such as LEDs (light emitting diodes). The use of LEDs in illumination systems is well known. These devices are especially useful for lighting components, systems, and finished goods. LED lighting is a fast growing segment of the lighting industry due to the efficiency, reliability and longevity of LEDs. Product usage applications include but are not limited to interior and exterior signage, cove lighting, architectural lighting, display case lighting, under water lighting, marine lighting, informational lighting, task lighting, accent lighting, ambient lighting and many others. Special adaptations included in the present invention make the product especially useful in existing lighting fixtures designed for low voltage incandescent bulbs.

INCORPORATION BY REFERENCE AND OTHER REFERENCES

Applicant incorporates by reference the following: U.S. patent application Ser. No. 12/385,613, Modified Dimming LED Driver, filed Apr. 14, 2009, McKinney et al.; U.S. patent application Ser. No. (not yet assigned), 90-260 Vac Dimmable MR16 LED Lamp, filed Sep. 18, 2009, McKinney, Steven; and U.S. Pat. No. 7,088,059, dated August 2006, McKinney et al. Other references cited herein include Introduction to Power Supplies, National Semiconductor Application Note AN-556, September 2002; "Understanding Buck Regulators", Super Nade, Overclockers.com—Nov. 25, 2006; MCP1630/MCP1630V High-Speed Pulse Width Modulator Data Sheet; MCP1630 Boost Mode LED Driver Demo Board User's Guide.

BACKGROUND OF THE INVENTION

LEDs are current-controlled devices in the sense that the intensity of the light emitted from an LED is related to the amount of current driven through the LED. FIG. 1 shows a typical relationship of relative luminosity to forward current in an LED. The longevity or useful life of LEDs is specified in terms of acceptable long-term light output degradation. Light output degradation of LEDs is primarily a function of current density over the elapsed on-time period. LEDs driven at higher levels of forward current will degrade faster, and therefore have a shorter useful life, than the same LEDs driven at lower levels of forward current. It therefore is advantageous in LED lighting systems to carefully and reliably control the amount of current through the LEDs in order to achieve the desired illumination intensity while also maximizing the life of the LEDs.

LED driving circuits, and any circuit which is designed to regulate the power delivered to a load can generally be categorized as either linear or active. Both types of circuits limit either the voltage, or current (or both) delivered to the load, and regulate it over a range of changing input conditions. For example, in an automotive environment the voltage available to an LED driving circuit can range from 9V to 15 Vdc. A regulator circuit is employed to keep the current delivered to the LEDs at a relatively constant rate over this wide input range so that the LED output intensity does not noticeably vary with every fluctuation in the system voltage.

Linear regulators are one type of device or circuit commonly employed to accomplish this task. A linear regulator keeps its output in regulation only as long as the input voltage is greater than the required output voltage plus a required overhead (dropout voltage). Once the input to the regulator drops below this voltage, the regulator drops out of regulation and its output lowers in response to a lowering input. In a linear regulation circuit, the input current drawn by the circuit is the same as the output current supplied to the load (plus a negligible amount of current consumed in the regulator itself). As the input voltage presented to the linear regulator rises, the excess power delivered to the system is dissipated as heat in the regulator. When the input voltage is above the dropout threshold, the power dissipated in the regulator is directly proportional to the input voltage. For this reason, linear regulators are not very efficient circuits when the input voltage is much larger than the required output voltage. However, when this input to output difference is not too great, linear regulators can be sufficient, and are commonly used due to their simplicity, small size and low cost. Because linear regulators drop out of regulation when the input is below a certain operating threshold, they can also be employed in LED driving circuits to effect a crude dimming function in response to an input voltage which is intentionally lowered with the desire to reduce the LED intensity. The dimming is "crude" in that it is not a linear response for two reasons. First, in the upper ranges of the input voltage above the dropout threshold, the regulator will hold the output in regulation and the LEDs will not dim at all. Once the dropout threshold is reached, the output voltage will drop fairly linearly with a further drop in input. However, LEDs are not linear devices and small changes in voltage result in large changes in current which correspondingly effect large changes in output intensity. As the voltage applied to an LED is lowered below a certain threshold, no current will flow through the LED and no light will be produced. FIG. 2 is an example of a linear regulator circuit configured to drive an LED load. FIGS. 3 and 4 give an example of the response of this linear regulated LED circuit to a dimmed input voltage.

The lower power efficiency of linear regulators makes them a poor choice in large power systems and in systems where the input voltage is much larger than the required LED driving voltage. As such, these systems typically do not employ them. Additionally, because of the requirement that the input voltage be higher than the output voltage in a linear regulator, it is not a viable choice where a higher output than input voltage is needed such as a low voltage source driving a series string of LEDs. As LEDs have increased in power and luminous output, it has become common to employ driving circuits that are active, meaning the power delivered to the end system is dynamically adapted to the requirements of the load, and over changing input conditions. This results in increased system efficiency and less heat dissipated by the driving circuitry. Such active driving circuits are commonly implemented using switching regulators configured as buck, boost, or buck-boost regulators with outputs that are set to constant-voltage, or constant-current depending on the circuit. Typically, in LED driving applications, the switching regulator circuit is adapted to sense the current through the LEDs, and dynamically adjust the output so as to achieve and maintain a constant current through the LEDs. FIG. 6 depicts a typical buck regulator circuit configured to drive an LED load at a constant current.

Many switching regulator devices have been specifically designed for driving high powered LEDs. Manufacturers have built into these devices, inputs which can be pulsed with a PWM (pulse width modulation) or PFM (pulse frequency modulation) control signal or other digital pulsing methods in order to effect a lowering of the output of the switching regulator specifically designed to dim the LEDs. Some devices also have analog inputs which lower the output to the LEDs in response to an input which is lowered over an analog range. With such dimming capabilities built into the switching regulators, very accurate linear dimming of the LEDs can be achieved. Such dimming is controlled via a network, or some user interface which generates input signals that are converted to the required digital pulses or analog signals that are sent to the switching regulator driver. This method of dimming in LED lighting systems is common. However, it requires control circuitry and user interface equipment which adds a level of cost and complexity to the lighting system.

In many cases, lighting systems and wiring are already installed, and it is desired to replace these lights with LED lights. Or, it is desired to add LED lights to an existing system and have them work in harmony with lights and equipment, which are not LED based. There are common household wall dimmers which are employed to dim incandescent lights, and there are high-end theatrical dimming systems which are used to dim entire lighting installations. These types of dimmers only affect the input voltage delivered to the Lights. There is no additional control signal which is sent to them. Therefore, LED lights which are designed to work in these systems must dim in response to a change in the input voltage.

As noted above, linear regulator based LED drivers will dim in response to a lowering of the input voltage. However the dimming is very non-linear and these regulators are inefficient. Switching regulator drivers will also fall out of regulation and dim their output when the input voltage drops below a certain threshold, but as with linear regulators, when the input is above a threshold, their outputs will be held in regulation and the LED intensity will remain unchanged. And, as in linear regulation circuits, when the switcher circuit is out of regulation, the LED response to the lowering output is very non-linear.

An even greater problem with dimming switching regulator drivers by lowering their input voltage is that these circuits need a certain start-up voltage to operate. Below this voltage, the switching regulator either shuts off completely, or provides sporadic pulses to the LEDs as it attempts to start-up, or passes some leakage current to the LEDs which causes them to glow slightly and never dim to zero. In LED circuits employing multiple lights, each driver circuit can have slightly different thresholds, resulting in differing responses at low dimming ranges. As a result, some lights may flicker, some may be off and some may glow below the threshold voltage. This is unacceptable in most lighting systems that are required to dim using standard ac dimming controllers.

The Modified Dimming LED Driver patent application referenced above detailed an LED driver based on efficient switching regulators which provides smooth and linear dimming from 100% to off, in response to the dimming input voltage that is provided with industry standard ac dimmers.

However, several difficulties arise when the input source for the driver circuit detailed in the referenced application is an electronic low-voltage transformer intended for use with an incandescent bulb. Such transformers are frequently found in track lighting and other low-voltage lighting fixtures.

These difficulties lie in the nature of the load presented by an LED lamp and its driving circuit, especially in the case of a small bulb replacement LED lamp. One of the advantages of an LED lamp over an incandescent lamp is its greater efficiency in converting electric energy into light. A typical incandescent bulb produces about 14-17.5 lumens per watt, and most halogen lamps produce about 16-21 lumens per watt. In comparison, LEDs achieving 80-100 lumens per watt are now common. Even when considering the power that is lost in the driving circuitry of an LED lamp which may be 60-80% efficient, LED lamps that are three to six times as efficient as incandescent and halogen bulbs are easily achievable. Thus an LED lamp designed to replace a halogen bulb for example would draw much less power from the transformer than the halogen for which the transformer was designed. This becomes a problem for many electronic transformers which require a minimum load to operate. Typical transformers designed to drive 50 W halogen bulbs will not start up with loads less than 10-20 W. An LED bulb designed to replace such a halogen may only draw 5-10 W. In fact, since a primary design goal for such an LED replacement lamp would be to produce similar light while drawing as little power as possible, the most efficient LED lamps would have a problem with many low-voltage electronic transformers.

It is common in the industry for such LED lamps to specify that they are only guaranteed to work with magnetic transformers. Another practice sometimes involves introducing a "dummy" load in the form of a resistor either externally or internal to the LED driver circuit. Such dummy loads may satisfy the transformer, allowing it to turn on and energize the lamp; however, they sacrifice the inherent efficiency of the LED lamp, and waste energy in the form of excess heat.

Another problem with an LED lamp operating from an electronic transformer is the type of load that the lamp provides. Regular incandescents and halogen lamps produce light when current through a tungsten filament causes it to heat up and glow white hot. The filament presents a resistive load to the transformer. In a resistive load, the current drawn by the load is directly proportional to the voltage applied to the load: $I=V/R$ where R is the resistance. As can be seen in FIG. 6, the input of a typical switching regulator circuit contains a bulk capacitor C1, which presents a capacitive load to the electronic transformer. In a capacitive load, the current is proportional to the change in voltage over time: $I=C\,\Delta V/\Delta T$. The faster the voltage changes, the greater the instantaneous current drawn. With a magnetic transformer supplying the input voltage, the input is a sinewave with the same 50-60 Hz frequency as the line input. In this case, the current "surge" is only great when the capacitor C1 is discharged and the power is switched on at close to the peak of the sinewave. This does not pose much of a problem with magnetic transformers which can handle the surge, and the switching regulator input circuitry can be protected from the surge with a simple added resistor or thermistor in series with the AC input. Thermistors are widely used as inrush current limiters in switching power supplies.

However, when using electronic transformers to drive capacitive loads, such as those presented by a typical switching regulator circuit, greater problems arise. This can be understood through an examination of the output waveform of an electronic transformer. As shown in FIG. 5, electronic transformers actually provide a pulsed PWM output with a 50-60 Hz sinewave envelope on the magnitude of the pulses. The frequency of the PWM output is typically 25-100 KHz. These PWM pulses present a much faster rise and fall of the input voltage (higher $\Delta V/\Delta T$) than a slow 60 Hz sinewave, causing high current spikes 25,000 to 100,000 times per second. These current surges not only stress the input components (rectifier diodes and bulk capacitors) of the switching regulator circuit, but in some cases could trigger over-current protection circuitry in the electronic transformer causing it to shut down.

For these reasons, many electronic transformers in existing incandescent and halogen lighting fixtures do not function properly with LED lamps retrofitted into the fixture. Common results include flickering, flashing, dim output illumination, or in many cases the LED lamp will not light at all. If the transformer functions and the lamp does operate, it may experience overheating of the input components and early life failure due to the input current spikes.

Even with some electronic transformers that will function with lighter loads, there is another phenomenon which presents a problem when driving an LED lamp. Most electronic transformers rely on the resistive load of an incandescent lamp in order to oscillate at their designed PWM frequency. The capacitive load typical of switching regulator circuits can cause the PWM frequency of the transformer output to shift, which in turn causes the RMS output voltage of the transformer to deviate from its designed level. This becomes a problem when the transformer is driving an LED circuit which is sensing the input RMS voltage in order to provide dimming of the LED output.

Circuits described in the Modified Dimming LED Driver patent application referenced above, are set to drive the LEDs to maximum illumination when the input voltage from the transformer is above a certain level. If the maximum input voltage of the driving transformer varies by transformer, then the dimming curve programmed into the LED driver circuit will be sub-optimal for some transformers. The LED output may not reach full intensity with some transformers that output a lower than expected voltage, and the dimming may not vary over the full possible range with transformers producing higher output voltage.

Because of the reasons discussed above, there is need in the industry for an LED lamp that overcomes the limitations of typical low-voltage electronic transformers, providing a load which is sufficient to cause such transformers to reliably energize, but which does not cause excessive current spiking, and which does not compromise the inherent efficiency of the LED bulb through wasted energy and excess heat dissipated in a "dummy" resistive load. There is also need for such an LED lamp to dim from full output to off when driven by transformers that vary their RMS output voltage in response to typical dimmers, and to be adaptable to various transformers such that the LED lamp may be retrofitted in a wide array of installed fixtures intended for incandescent lamps.

It is an object of the present invention to provide a complete LED lamp with integral dimmable driving circuitry such as that disclosed in the Modified Dimming LED Driver application referenced above, and which functions with a wide variety of previously installed electronic and magnetic low-voltage transformers designed for incandescent bulbs. It is a further object of the present invention to provide an LED lamp which sufficiently loads such electronic transformers to cause them to energize, but which does not detract significantly from the efficiency of the LED lamp through an added resistive "dummy" load, and which diminishes the problematic current spikes seen with typical capacitive loads. It is yet a further object of the present invention to provide an LED lamp with a dimmable illumination output which is maximized to the capabilities of the particular low-voltage transformer, and which adapts automatically to each transformer, providing the maximum desired LED output illumination when the particular driving transformer is providing its maximum voltage output.

BRIEF DESCRIPTION OF THE DRAWINGS

FIG. 1 is a graph showing a typical relationship of relative luminosity to forward current in an LED.

FIG. 2 is a diagram of a linear regulator circuit as an LED driver.

FIG. 3 is a graph showing the relationship of the luminous intensity of the LEDs vs. the input voltage in a linear regulated LED circuit.

FIG. 4 is a graph of the dimming response in a linear regulated LED circuit.

FIG. 5 is an illustration of the output voltage waveform of a typical low-voltage electronic transformer.

FIG. 6 is an illustration of a typical buck regulator circuit driving an LED load at a constant current.

FIG. 7 is a block diagram of a Modified Dimming LED driver implemented in a buck regulator circuit as disclosed in the Modified Dimming LED Driver patent application cited above.

FIG. 8 is a circuit diagram of the Modified Dimming LED driver disclosed in the Modified Dimming LED Driver patent application cited above.

FIG. 9 is the power circuit for the Modified Dimming LED Driver of FIG. 8 as disclosed in the Modified Dimming LED Driver patent application cited above.

FIG. 10 is the circuit diagram of the LED driver of FIG. 8, with input modifications for low-voltage electronic transformers.

FIG. 11 is an illustration of the Ideal LED Lamp output intensity dimming curve.

FIG. 12 is an illustration of the LED Lamp output intensity dimming curve with a transformer producing 13.0V in a standard (non-adapted) configuration vs. the dimming curve when adapted to the transformer.

FIG. 13 is an illustration of the LED Lamp output intensity dimming curve with a transformer producing only 11.0V in a standard (non-adapted) configuration vs. the dimming curve when adapted to the transformer.

FIG. 14 is a summary flowchart for the transformer adapting firmware encoded in the microcontroller of FIG. 10.

FIG. 15 is an exploded view and assembled view of one embodiment of the invention.

SUMMARY OF THE INVENTION

The present invention is directed to an integral LED lamp adapted to fit industry standard MR16 sized fixtures in place of incandescent or halogen bulbs, and which may be driven by low-voltage electronic transformers commonly existing in such fixtures. An advantage of the present invention is that it is dimmable when coupled with dimmable transformers and existing dimming circuits, and adapts its output illumination to achieve the best dimming curve from maximum to off, based on the capabilities of the transformer. A further advantage of the present invention is that it provides an additional active load causing transformers requiring minimum loads to energize, without the efficiency-robbing disadvantage of a resistive dummy load. Further advantages of the invention will become apparent to those of ordinary skill in the art through the disclosure herein.

DETAILED DESCRIPTION OF THE INVENTION

FIG. 6 shows a diagram of a typical buck switching regulator circuit configured to output a constant current to an LED load. A detailed description of the operation of a buck switching regulator is beyond the scope of this discussion, but can be found in such reference documents as the National Semiconductor application note AN-556, and the article "Understanding Buck Regulators", both cited above.

Referring to FIG. 6, the rectifier bridge, CR1 transforms the ac input voltage (which alternates in polarity from positive to negative in a sinusoidal fashion) to a rectified (all positive) voltage to the input VIN of the regulator U1. The bulk capacitor C1 provides storage and smoothes out the rectified ac into a dc voltage. The switching regulator U1 using an internal pass transistor (not shown) will connect the input voltage VIN to the inductor L1 through U1 output VSW. This causes current to flow through the inductor L1, and the capacitor C2 begins to build up a charge. As the C2 voltage builds up, a current will begin to flow through the LED load and feedback resistor $R_{SENSE}$ causing a sense voltage to appear at the U1 feedback input FB according to the equation $FB=I_{OUT}\times R_{SENSE}$. An internal comparator circuit (not shown) within U1 senses when FB reaches a predetermined level, and then disconnects the input VIN from VSW. As the LOAD draws current from the circuit, the capacitor C2 begins to discharge, and the sense voltage FB begins to drop. The switching regulator senses the drop on FB, and then reconnects the input VIN to the inductor L1. based on the values of L1, C1 and the sense resistor $R_{SENSE}$, U1 will continue connecting and disconnecting the input voltage VIN to the inductor L1 in order to keep the output at a level which provides the proper feedback voltage FB. This connecting and disconnecting operation in a pulsed fashion causes the output current $I_{OUT}$ to regulate at a constant level which can be shown from the previous equation to be $I_{OUT}=FB\times R_{SENSE}$. The circuit detailed in FIG. 6 is called a constant current output, because it regulates the output current IOUT that is presented to the load.

FIG. 6 shows an additional input, PWM on the switching regulator U1 which is sometimes available on these regulators, especially recent devices tailored for LED driving applications. This input allows the regulator output to be reduced according to the relative duty cycle of the PWM input pulses when such a control signal is presented. These input pulses can represent any digital pulsed modulation technique, provided the frequency and "on" and "off" pulse durations fall within the specified parameter ranges of the regulating device.

FIG. 7 shows a similar Buck regulator circuit adapted to provide a constant current to an LED load, but with the added ability to sense changes in the input voltage via the U3 filter circuit, and which incorporates a microcontroller U4 to convert these changes in input voltage into corresponding changes in output illumination through dimming pulses sent from the microcontroller U4 to the switching regulator U2. This dimmable LED driver concept was first disclosed in the Modified Dimming LED Driver Patent Application referenced above. A more detailed diagram of this concept implemented in a Buck-Boost regulator circuit was also disclosed and is shown here for reference in FIGS. 8 and 9.

As shown in FIG. 8, the regulator circuit is based on the Microchip Technology Inc. MCP1630V High-Speed, Microcontroller-Adaptable, Pulse Width Modulator developed for implementing intelligent power systems. A Detailed explanation of the operation of the MCP1630V and the Boost Mode LED driver circuit can be found in the references sited above. However, following is a basic description of the operation of this circuit.

The implementation of the regulator circuit in FIG. 8 is a modification of the standard Boost Mode LED driver provided by Microchip in that the extra capacitor C12 and inductor L4 have been added to convert the regulator topology to a Buck-Boost configuration. In this configuration, the output voltage required to drive the LED load can be higher or lower than the input voltage provided to the circuit. This circuit is adapted to drive a series string of five one-watt high-intensity LEDs from a dimmable 12 Vac input.

Referring to FIG. 8, the 12 Vac input is first rectified through the Bridge CR3, and smoothed by the bulk input capacitor C5 to produce the 12 VDC input. In actual operation, the 12 VDC signal may not be a steady DC level, but may have some amount of ripple based on the size of the input capacitance C5, and considering the high output current (350 mA) presented to the LED load. Assuming a 12 Vac sine wave input, the 12 VDC will have a peak voltage of $V_{PEAK}=(V_{IN}*\sqrt{2})-V_{BRIDGE}$ where $V_{BRIDGE}$ is equivalent to two standard diode voltage drops through the Bridge CR3. Therefore, 12 VDC will have a peak of about (12*1.414)−(2*0.7)=15.6V. At 3.6 to 4.0V forward voltage drop for the white LEDs intended for this implementation, the five series LED load will require about 18V-20V when driven at the rated 350 mA output, so the regulator will usually be boosting the output voltage in this application.

The resistor R14 in FIG. 8 serves as the output current sense resistor which presents a voltage at the FB pin of the MCP1630V (U6) that is proportional to the output current being supplied to the LED load, which returns through the LED-connection through R14 to ground.

The MCP1630V PWM controller (U6) is comprised of a high-speed comparator, high bandwidth error amplifier and set/reset flip flop, and has a high-current driver output (pin VEXT) used to drive a power MOSFET Q1. It has the necessary components to develop a standard analog switch-mode power supply control loop. The MCP1630V is designed to operate from an external clock source which, in this circuit, is provided by the microcontroller (U5). The frequency of the clock provided by the GP2 output of U5 and presented to the OSC_IN input of U6, sets the buck-boost power supply switching frequency. The clock duty cycle sets the maximum duty cycle for the supply.

The microcontroller U5 in the circuit of FIG. 8 operates from its own internal oscillator and has an on chip Capture/Compare/PWM (CCP) peripheral module. When operating in PWM mode, the CCP module can generate a pulse-width modulated signal with variable frequency and duty cycles.

In this circuit, the CCP module in U5 is configured to provide a 500 kHz clock source with 20% duty cycle. The 20% duty cycle produced by the CCP module limits the maximum duty cycle of the MCP1630 to (100%−20%)=80%. The clock frequency and duty cycle are configured at the beginning of the microcontroller software program, and then free-run.

The CCP output is also connected to a simple ramp generator that is reset at the beginning of each MCP1630V clock cycle. The ramp generator is composed of transistor Q2, resistors R2, R3 and capacitor C10. It provides the reference signal to the MCP1630V internal comparator through its CS input. The MCP1630V comparator compares this ramp reference signal to the output of its internal error amplifier in order to generate a PWM signal. The PWM signal is output through the high-current output driver on the VEXT pin of U6. This PWM signal controls the on/off duty cycle of the external switching power MOSFET Q1 which sets the power system duty cycle so as to provide output current regulation to the LED load.

A resistor voltage divider (R5 and R6) and filter capacitor C8 is used to set the reference voltage presented to the internal error amplifier of the MCP1630V for the constant current control and is driven by the GP5 pin of the microcontroller U5. With GP5 set to logic level 1, the voltage presented to the resistor divider is 3.3V. The voltage present on the VREF input of U6 will be 3.3V*R5/(R5+R6)=196 mV. Therefore the internal error amplifier of U6 will trip when the voltage presented to the FB pin reaches 196 mV. This occurs when the LED current=0.196/0.56 (R14). So, with the component values shown in the implementation of FIG. 10, the regulated LED current is 350 mA.

R4 and C11 form an integrator circuit in the negative feedback path of the internal error amplifier in U6, providing high loop gain at DC. This simple compensation network is sufficient for a constant current LED driver.

R9 and R10 form a voltage divider that is used to monitor the output voltage of the buck-boost circuit. The output of this voltage divider is connected to pin GP4 of the microcontroller U5 and monitored in the software program to provide failsafe operation in case the LED load becomes an open circuit. Since the buck-boost power circuit would try to increase (boost) the output voltage to infinity in the case of a disconnected load (the error amplifier in U6 would never trip), the software program in the microcontroller U5 monitors the feedback voltage V_FB to ensure it stays at a safe level. In normal operation, the intended 5 LED load would require a maximum of 20V to drive at 350 mA. In this case, V_FB=20V*R10/(R9+R10)=2.2V. If V_FB rises above this level, the microcontroller U5 can shut off the clock to the MCP1630V U6.

L3, Q1, C12, L4, D5, and C13 form a basic voltage buck-boost circuit. Details of the operation of a buck-boost regulator circuit are beyond the scope of this discussion, however, will be understood by those skilled in the art. The value of C13 can be selected to keep the LED current ripple less than a desired level at the rated load conditions.

FIG. 9 details the power circuitry used to provide 5V to the MCP1630V (U6 in FIG. 8), and 3.3V to the microcontroller (U5 in FIG. 8). The rectified voltage 12 VDC is presented to U7, a 5V low drop out (LDO) linear regulator which provides the input voltage VIN to U6. The 5V output of U7 is also presented through diode D6 to U8, a 3.3V LDO linear regulator which provides the 3.3V to the U5 microcontroller in FIG. 8. In this embodiment of the invention, it is desirable to run the microcontroller U5 at a lower voltage to ensure it has stable power to monitor and control the circuit when the input voltage is dimmed to the point where it is desired to have the LEDs off.

For the circuit of FIGS. 8 and 9 to function as a standard buck-boost regulator and drive a regulated 350 mA current to the output LED load, all that is necessary in the microcontroller U5 software program is to initialize the CCP module in PWM mode as discussed above, in order to produce the clock to the MCP1630V U6, and to drive its output pin GP5 high in order to provide the voltage reference for the MCP1630V control loop.

However, as disclosed in the Modified Dimming LED Driver Patent Application referenced above, additional circuitry is in place to allow the microcontroller U5 to sample the input voltage, and with additions to the software, intelligently dim the LED output by controlling the MCP1630V U6.

R7, R8, and C6 in FIG. 8 form a voltage divider and filter which samples the rectified input voltage 12 VDC from the bridge CR3, and presents it to the microcontroller U5 on input GP0. Note that if the bulk capacitor C5 were large enough to filter the input to DC, the 12 VDC voltage level would be 15.6V as explained above, and the voltage at GP0 of U5 would be $V_{GP0}$=15.6*R8/(R7+R8)=5.2V. However, in this implementation, there is considerable ripple on the 12 VDC voltage, and the actual voltage presented to GP0 of U5 is much less. The values of these components have been chosen to present an average of 3V to the microcontroller U5 when the input is 12 Vac. As the input voltage is dropped below 12 Vac the voltage presented to GP0 of U5 will correspondingly lower. The microcontroller is programmed to monitor this input and execute a dimming algorithm based on the sampled input voltage level.

In this LED driver circuit implementation first disclosed in the Modified Dimming LED Driver Patent Application referenced above, the dimming algorithm has been set to begin dimming when GP0 drops below 3V, and dim linearly to off when GP0 drops to 50% (1.5V). At 50%, there is still sufficient voltage on the 12 VDC line to reliably power the microcontroller U5 and the MCP1650V U6. Thus, a stable linear dimming output is achieved which is consistent from LED lamp to LED lamp.

Depending on the values of the voltage divider and filter components (R7, R8, and C6 of FIG. 8), there will be some amount of 60 Hz ripple on the voltage presented to GP0 of U5. The microcontroller can be programmed to take a number of samples of this voltage and then average the result in order to further filter the sampled input level so that no 60 Hz ripple is passed on to the LEDs. The microcontroller program may also execute a root-mean-squared (RMS) calculation on the input samples in order to get a more accurate reading of the input voltage level.

The output dimming in this circuit is achieved through manipulation of the VREF reference voltage presented to the internal error amplifier of the MCP1630V U6. As explained above, when the GP5 output of U5 is set high, the VREF input of U6 will be 196 mV, and the output current will regulate at 350 mA which has been chosen to be the maximum (no dimming) current output through the LEDS. With GP5 low, VREF will be 0V, and no current will be output to the LEDs. Under software control, the microcontroller pulses this output in a PWM or PFM (where both pulse width and cycle time of the pulses are manipulated) fashion to cause the LED current to alternate between 0 and 350 mA at a rate that is undetectable to the human eye, and which results in a dimmed illumination level proportional to the PFM duty factor (DF).

As noted in the Modified Dimming LED Driver Patent Application referenced above, the value of capacitor C8 in FIG. 8 can be chosen to filter out the GP5 pulses, and integrate them into an analog voltage level so that the LED current reduces in absolute value, rather than pulsed between maximum and minimum levels. Thus, the pulse integration occurs at the circuitry level rather than with the human eye.

This circuitry and method for dimmably driving LEDs was first disclosed in the Modified Dimming LED Driver Patent Application referenced above. It has been incorporated into the present invention as the method of driving a series connected string of 5 LEDs from a 12 Vac input. In the present invention, this driving circuitry is implemented on a small Printed Circuit Board incorporated into the base of a thermally conductive shell which has been sized to fit a common bulb size referred to as an MR16. The MR designation in the lighting industry stands for "metal reflector", referring to the typical parabolic metal reflector shape used to focus the light emitted from the bulbs in a forward direction. The parabolic reflector is not needed with LED technology, as the LEDs are by nature directional light emitters. The "16" in the MR16 bulb designation refers to the diameter of the bulb in eights of an inch (16 eights=2.0" diameter). MR16 is a common size bulb in the lighting industry, used in many track lighting and recessed can fixtures. FIG. 15 shows the major components of one embodiment of the present invention.

As discussed in the Background section above, there are difficulties that arise when coupling a switching regulator LED driver, such as that disclosed in the Modified Dimming LED Driver Patent Application, with an electronic low-voltage transformer commonly used to drive standard MR16 bulbs. We will now discuss additions and modifications to the prior art LED driving circuitry which overcome these difficulties. Referring to FIG. 10, it can be seen that four additional components (F1, L5, C16, and R15) have been added to the input of the prior-art circuit of FIG. 8. The resistivity of a tungsten filament is approximately three times that of copper at room temperature. A 12V 50 W halogen MR16 bulb has a filament resistance on the order of a couple hundred milliohms. However, as the filament is heated to incandescence, its resistivity increases several thousand percent. As discussed in the background section above, electronic transformers are designed to drive this type of resistive load, and often require a low resistance at the load in order to start up and operate. Also as noted above, prior art methods of adding "dummy" resistive loads to aid the transformer in starting up, have the drawback of dissipating the extra power as heat, and reducing the luminous efficacy (ratio of luminous output to power dissipated) of the LED lamp.

The component designated as F1 at the input of the circuit of FIG. 10 provides this low resistance to aid the transformer in start-up, without sacrificing luminous efficacy. This component is a polymeric positive temperature coefficient device (PPTC, commonly known as a resettable fuse or polyswitch). A PPTC is a passive electronic component normally used to protect against overcurrent faults in electronic circuits. PPTC devices are actually non-linear thermistors, which cycle back to a conductive state after the current is removed. A PPTC device has a current rating. When the current flowing through the device, (which has a small resistance in the "ON" state) exceeds the current limit, it warms up above a threshold temperature and its electrical resistance suddenly increases several orders of magnitude to a "tripped" state where the resistance will typically be hundreds or thousands of ohms, greatly reducing the current. When the power is removed, the PPTC device cools within a couple of seconds, and then again passes the rated current when power is reapplied.

Instead of its normal use as a resettable fuse (where it would be connected in series with the power input), the polyswitch F1 is being used to simulate the electrical characteristic of a tungsten filament. When there is no power applied, and therefore no current through F1, it has a low resistance of a couple hundred milliohms similar to the tungsten filament. This provides a low resistance current path at initial power-up similar to a halogen lamp, helping the electronic transformer to start normally. Once the transformer starts and supplies power to the circuit, the polyswitch F1 quickly heats and "trips", increasing its resistance to the point where the current flowing through it is a negligible amount. While power remains applied, the polyswitch F1 remains in this high resistance state, drawing negligible power, and therefore not detracting from the efficacy of the LED Lamp. This novel use of the polyswitch device F1 effectively provides a "dummy" resistive load which is quickly removed from the circuit after power-up.

As noted in the background section above, the high $\Delta V/\Delta T$ presented by the PWM pulses of an electronic transformer can cause high current spikes when driving a switcher regulator circuit, which stress the input rectifier diodes and bulk capacitors and can cause excessive heat and failure of these components. In order to overcome this problem, an inductor L5 has been added in series with the input of the LED driver circuit in FIG. 10. The inductor limits instantaneous changes in the current flowing through it, and therefore reduces the magnitude of the PWM current spikes. This can be seen from the equation relating voltage and current in an inductor: $V=L(\Delta I/\Delta T)$, which can be rewritten as $\Delta I/\Delta T=V/L$. Therefore, the greater the inductance, the greater the limiting effect, but also the greater the physical size of the inductor. In this embodiment of the invention, a 15 uH 2A inductor achieves a good balance between physical size, which is limited by the small area available in the MR16 shell for the LED driver circuit, and the desired input current spike reduction.

The addition of L5 to the input circuit also helps to improve the power factor of the circuit as it lessens the capacitive effect and reduces the current spikes. The input current pulses charging the bulk capacitor C5 get "spread" over a longer $\Delta T$ period.

At lower input voltages, such as when the electronic transformer is being dimmed with an auto transformer type dimmer, the sinewave envelope of the transformer output waveform will be correspondingly reduced in amplitude (refer to FIG. 5). In this case, the LED driver circuit will be dimming the LEDs as discussed above, which will result in less power being drawn from the electronic transformer. The LED Lamp is then providing an even lower load to the transformer than under non-dimmed conditions. In order to help the electronic transformers oscillate correctly, the capacitor C16 and resistor R15 provide a low impedance path for high frequency current. The capacitor value is set so that the 25 to 100 KHz PWM oscillation from the electronic transformers produces short current pulses of sufficient magnitude at each PWM cycle to cause the transformer to oscillate. The resistor R15 serves to limit the magnitude of the high frequency current pulses. Practical experimenting with electronic transformers from various manufacturers have shown that a C16 value of about 15 nanofarads coupled with an R15 of about 6.65 ohms produces enough of a load to keep the transformers oscillating correctly under a wide range of dimming conditions.

Because the LED driver circuit of FIG. 10 dims the LEDs based on the sampled level of the input voltage which is assumed to be 12.0V nominal at full-on (non-dimmed), any input voltage less than this (or less than a programmed threshold level) would result in reduced output illumination. This could compromise the output LED intensity in the case of a transformer that did not output the full 12.0V when not dimmed. Magnetic transformers which output a simple fraction multiple of their input voltage (based on the turn ratio of their windings) are dependant on the nominal line voltage input to produce the 12V output. For example, a typical turns ratio of 10:1 would produce 12.0V output with 120V input. Line voltage may actually vary from 110V to 125V from region to region, or even building to building in the same location. In addition, the output voltage of the magnetic transformer can be affected by the load. A magnetic transformer loaded to close to its maximum rated capacity will output a voltage slightly lower than the same transformer driving a lighter load. In practice, it is common to see anywhere from 11.0V to 13.5V output from a 12V magnetic transformer.

Electronic transformers present their own problems with output voltage levels. As mentioned in the Background section above, most low-voltage electronic transformers are designed to drive halogen incandescent bulbs which present a resistive load to the transformer. The transformer circuitry relies on this low impedance resistive load to operate correctly. While the additional input circuitry described above and incorporated in the embodiment of the present invention helps the transformer to energize and produce an output voltage, the LED lamp load is still not equivalent to the low impedance resistive load the transformer circuitry expects. As a result, the frequency of the electronic transformer's PWM pulsed output can vary from its designed frequency, which in turn affects the RMS output voltage of the transformer. So, with an expected 12.0 Vac input, the LED lamp could actually be driven with anywhere from 10.0V to 14.0V depending on these variable conditions.

The present invention includes an Adapting Algorithm in the microcontroller firmware which allows it to dynamically adjust and adapt to the capabilities of the particular transformer that is providing the input voltage. This Adapting Algorithm learns the capabilities of the transformer and adjusts the LED output intensity and the dimming curve of the output to best suit this capability. The algorithm can best be understood through an examination of FIGS. 11 through 14.

FIG. 11 shows a graphical representation of the Ideal LED Lamp Output Intensity Dimming Curve for this embodiment of the invention. Here, 12.0 Vac is the expected maximum input voltage received from the transformer when the transformer input is not dimmed (either connected to a non-dimming circuit, or connected to a dimming circuit which is set at 100% output). 6.0 Vac is chosen as a safe minimum voltage for The LEDs to be turned off. This gives enough voltage for the components of the driver circuit of FIG. 10 to still function reliably, giving a stable shut down of the Lamp. The Luminous intensity curve is shown as a linear progression of luminous output from "Off" at 6.0V to full "On" (maximum regulated current through the LEDS) at 12.0V. As discussed in the Modified Dimming LED Driver patent application cited above, the dimming curve need not be linear, but could be weighted to provide any number of effects including mimicking the dimming response of a halogen bulb. For this embodiment, a linear response is chosen.

Now, for reasons discussed above, the LED Lamp may be driven by a transformer that produces 13.0 Vac as the maximum non-dimmed voltage. FIG. 12 illustrates the resulting illumination from an LED lamp if programmed to produce the curve of FIG. 11, under these conditions. As can be seen from FIG. 12, in the uppermost range of input voltages from 12.0V to 13.0V, no change in output illumination would occur since the LEDs are already at maximum illumination once the input reaches 12.0V. Under these conditions therefore, the dimming response is compromised, as the LED Lamp does not take full advantage of the range of dimming input voltages provided by the transformer. In order to optimize the dimming curve for this situation, the dimming algorithm needs to be shifted (stretched) to dim from off at 6.0V input to maximum illumination at 13.0V.

Now referencing FIG. 13, we can see the effect when an LED Lamp programmed with the dimming curve of FIG. 11 is driven from a transformer producing 11.0V as its maximum output. Since the dimming algorithm is set for a range of 6.0V to 12.0V, when this transformer is at its maximum output of 11.0V, the LED Lamp would only be at 83% of its intended maximum illumination. In this situation, the illumination output is compromised. In order to produce the full illumination for which the Lamp is capable, the dimming algorithm needs to be shifted (compacted) to dim from off at 6.0V input to maximum illumination at 11.0V.

An advantage of the present invention is in the capability of the LED Lamp to dynamically adjust to these conditions, and alter its dimming curve to take maximum advantage of each transformer's capability. This is achieved through a "transformer adapting algorithm" programmed into the microcontroller U5 of FIG. 10. Referring to FIG. 14, the transformer adapting algorithm can be understood from a study of the simplified flowchart. The microcontroller program stores a variable in memory representing the maximum sampled RMS input voltage, RMS_MAX. At initial Power "On" this value is defaulted to 11.0V. The minimum sampled RMS input voltage representing the point below which the LEDs are turned off RMS_MIN is set to 6.0V. The microcontroller then takes a number of samples of the input voltage and calculates the RMS value of these samples. This RMS value is stored as RMS_IN. Next the RMS_IN value is compared with RMS_MAX to determine if the input is below the previously stored maximum value. If so, RMS_IN is then compared to RMS_MIN to see if the input is within the dimming range. If so, the dimming level DIM_LVL is calculated based on The RMS_IN value's percentage within the RMS_MAX-RMS_MIN range. The microcontroller's PWM (or PFM) dimming output (GP5 of U5 in FIG. 10) duty factor is then set to this dimming level. Dimming of the LED illumination then occurs as detailed in the circuit explanation above. The microcontroller code then loops back to continue sampling the input voltage.

If, at any time, the input voltage RMS_IN falls below the preset 6.0V minimum, the DIM_LVL value is set to "0", and the LEDs will be turned off as the microcontroller outputs logic low on GP5 of U5 in FIG. 10. This is shown in the flowchart of FIG. 14 as the "No" branch (N) from the second decision block.

Referring to the "No" (N) branch from the first decision block of the flowchart of FIG. 14, it can be seen that if the RMS_IN value rises above the previously stored RMS_MAX value of 11.0V, the RMS_MAX value is updated and stored as this new higher value. The DIM_LVL is then set to 100%, and the LEDs are turned full on. In this way, the microcontroller keeps a running value of the maximum voltage that the transformer provides. When the input voltage then drops below this new maximum voltage, the dimming curve is automatically adjusted as the DIM_LVL is calculated with the new RMS_MAX value. FIGS. 12 and 13 show the dimming curve as it would be with the LED Lamp programmed with the adapting algorithm. It can be seen then, that the dimming curve will be maximized to any transformer's capability the first time the controlling dimmer circuit is raised to 100% following power-on.

The initial default value of 11.0V for RMS_MAX is chosen as a reasonable low level to include a wide range of transformers without greatly compromising the initial power-on dimming curve. This is an arbitrary value which can be factory programmed to any level based on the expected environment. The lower the default, the greater the range of "adaptability" to lower voltage transformers, but the greater the compromise of the dimming curve prior to "adapting."

Thus, with the microcontroller U5 of FIG. 10 programmed with the transformer adapting algorithm, the LED Lamp dynamically "learns" the capability of the driving transformer, and adjusts the dimming curve to achieve the optimal results. This algorithm, combined with the other components of the present invention as described above, produce an MR16 LED Lamp which is capable of retrofitting into a wide array of installed lighting fixtures, and which produces optimum illumination and dimming performance with any low-voltage transformer.

What is claimed is:

1. An LED lamp comprising: One or more high-power LEDs, and a switcher regulator LED driver circuit such as a buck, boost, buck-boost or sepic topology circuit, said LED driver circuit receiving input voltage from conventional low-voltage lighting transformers, sampling said input voltage, and producing varying levels of regulated current to said LEDs in proportion to varying changes in the relative value of said input voltage, and causing the output intensity of said LEDs to increase and decrease in response to corresponding increases and decreases in the relative value of said input voltage; and containing input circuitry providing loading to said lighting transformers, and causing said lighting transformers to energize and produce said voltage to said LED Lamp, said input circuitry comprising: a PPTC device connected across the power input conductors, providing a low resistance current path at initial application of said input voltage, and providing a high resistance thereafter, until said input voltage is removed; and a high-pass filter connected across said power input conductors, said high-pass filter: providing a low resistance current path during high frequency pulse edges of said input voltage, and producing current pulses of sufficient magnitude at said high frequency pulse edges to cause said lighting transformers to oscillate at designed frequency when said conventional transformers are electronic type requiring a minimum load current to operate, a thermally conductive shell forming a mounting surface for said LEDs, said shell containing a cavity housing said LED driver circuit, and providing a thermally conductive path to transfer heat from said LEDs and said driver circuit through said shell and into surrounding air; and a base enclosing said cavity of said shell, and receiving said input voltage from said lighting transformers through conductive contacts in said base, and passing said input voltage to said LED driver circuit.

2. The LED lamp of claim 1 wherein said shell conforms to the lighting industry standard MR16 bulb size, and said base conforms to the lighting industry standard MR16 bi-pin size.

3. The LED lamp of claim 2 wherein said high-pass filter is a series configured capacitor and resistor.

4. The LED Lamp of claim 3 wherein said input circuitry of said LED driver circuit additionally contains an inductor connected in series with one of said power input conductors, said inductor restricting the magnitude of current pulses produced from high PWM signals that have a high rate of change in voltage over time, such as when said lighting transformer is a low-voltage electronic transformer.

5. The LED Lamp of claim 1 wherein, said LED Driver circuit contains a microcontroller, said microcontroller programmed to:

sample voltage level of said input voltage, and compare said sample to a pre-programmed range, and cause regulated current to said LEDs to be adjusted according to a programmed formula in proportion to the relative value of said input voltage as compared to said pre-programmed range, and dynamically adjust pre-programmed range according to the history of said sampled voltage levels, said adjustment tracking the maximum capable voltage level of said lighting transformer, and thereby adapting said pre-programmed range to account for said lighting transformer having an actual maximum voltage capability which is higher or lower than said lighting transformer's rated output voltage.

6. The LED Lamp of claim 5 wherein said programmed formula produces a linear progression from zero to maximum as said sampled voltage level ranges from a preset minimum value to said adjusted maximum value.

7. The LED Lamp of claim 6 wherein said preset minimum value is defined as a positive voltage sufficient for said microcontroller to remain operational, causing a deterministic shut-down of said LED driver.

8. The LED Lamp of claim 5 wherein said programmed formula produces a progression of regulated current to said LEDs over said range such that the illumination output curve of said LEDs mimics the intensity change response of a separate illumination source subject to the same input voltage.

9. The LED Lamp of claim 8 wherein said separate illumination source is a halogen bulb.

10. The LED Lamp of claim 4 wherein, said LED Driver circuit contains a microcontroller, said microcontroller programmed to: sample voltage level of said input voltage, and compare said sample to a preset range, and cause regulated current to said LEDs to be adjusted according to a programmed formula in proportion to the relative value of said input voltage as compared to said preset range, and dynamically adjust preset range according to the history of said sampled voltage levels, said adjustment tracking the maximum capable level of said lighting transformer.

11. The LED Lamp of claim 10 wherein said programmed formula produces a linear progression from zero to maximum as said sampled voltage level ranges from a preset minimum value to said adjusted maximum value.

12. The LED Lamp of claim 11 wherein said preset minimum value is defined as a positive voltage sufficient for said microcontroller to remain operational, causing a deterministic shut-down of said LED driver.

13. The LED Lamp of claim 10 wherein said programmed formula produces a progression of regulated current to said LEDs over said range such that the illumination output curve of said LEDs mimics the intensity change response of a separate illumination source subject to the same input voltage.

14. The LED Lamp of claim 13 wherein said separate illumination source is a halogen bulb.

* * * * *